United States Patent [19]

Browning

[11] 3,954,302

[45] May 4, 1976

[54] APPARATUS FOR VENTILATING CUTTER HEADS OF MINERAL MINING MACHINES

[75] Inventor: Eric John Browning, Lichfield, England

[73] Assignee: Coal Industry (Patents) Limited, London, England

[22] Filed: Dec. 27, 1974

[21] Appl. No.: 536,739

[30] Foreign Application Priority Data

Jan. 18, 1974 United Kingdom ..... 02430/74

[52] U.S. Cl. ..... 299/81

[51] Int. Cl.[2] ..... E21C 25/10

[58] Field of Search ..... 299/81, 12, 45, 46, 299/89

[56] References Cited

UNITED STATES PATENTS

| | | | |
|---|---|---|---|
| 3,767,265 | 10/1973 | French et al. | 299/81 |
| 3,843,199 | 10/1974 | Nash et al. | 299/81 |
| 3,904,246 | 9/1975 | Gandy | 299/81 |

FOREIGN PATENTS OR APPLICATIONS

| | | | |
|---|---|---|---|
| 1,206,955 | 9/1970 | United Kingdom | 299/12 |
| 1,187,768 | 4/1970 | United Kingdom | 299/12 |

*Primary Examiner*—Frank L. Abbott
*Assistant Examiner*—William F. Pate, III
*Attorney, Agent, or Firm*—Stevens, Davis, Miller & Mosher

[57] ABSTRACT

A rotary cutter head of a mining machine having a hollow or axially bored driven shaft, is fed with dust suppression fluid through a tube extending along the axis of the driven shaft and is ventilated by an air flow induced along the bore of the shaft by an air flow-inducing nozzle mounted remote from the axis of the shaft.

8 Claims, 2 Drawing Figures

APPARATUS FOR VENTILATING CUTTER HEADS OF MINERAL MINING MACHINES

Figure 1:
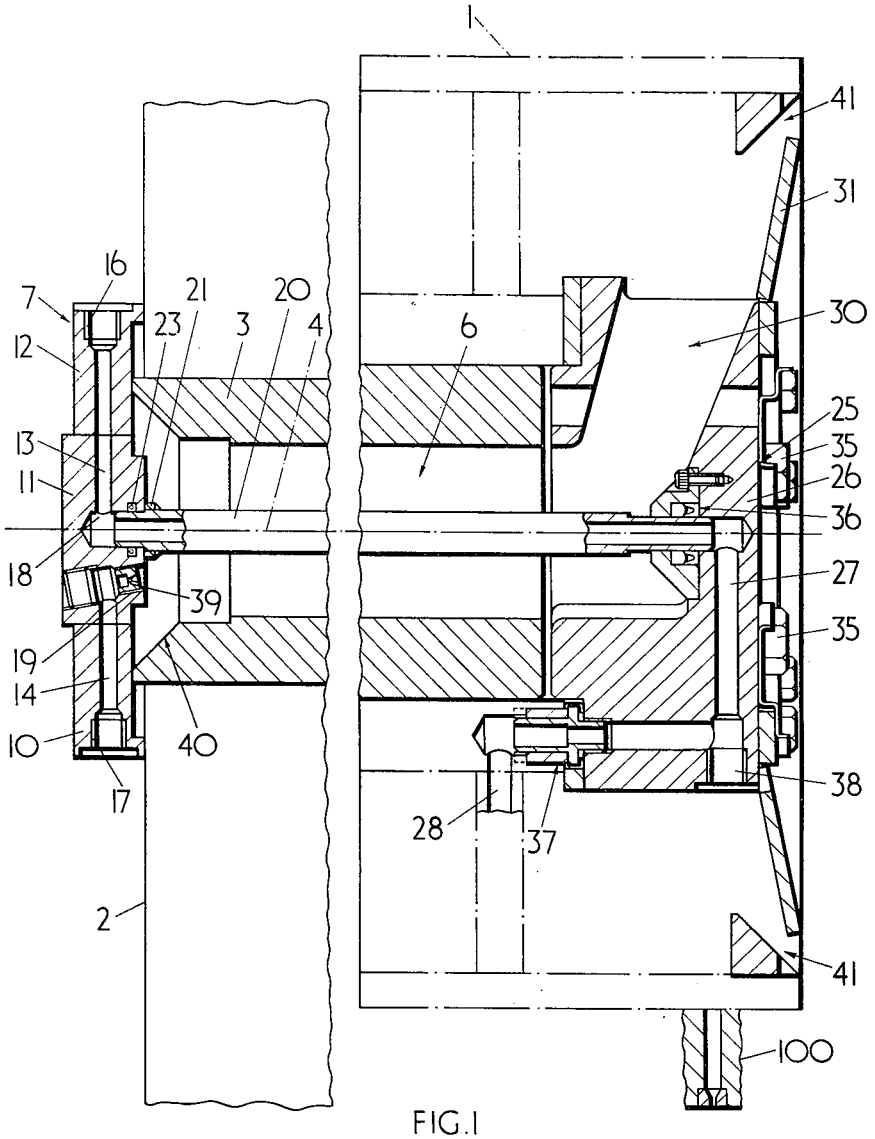

This invention relates to apparatus for ventilating cutter heads on mining machines and has particular application to a mining machine of the kind comprising a rotary cutter head mounted on a hollow or axially bored drives shaft and provided with at least one outlet spray for dust suppression fluid.

One known cutter head has a series of water outlet sprays arranged around its periphery which are supplied with relatively low pressure water from a flexible hose connecting the machine to a pressure supply, the water flowing from the hose through a tube arranged within the bore of the driven shaft to a distributor mounted centrally within the cutter head. Water is sprayed from the outlet sprays towards the cutting zone of the cutter head to suppress dust generated during cutting. It has also been proposed to ventilate such a cutter head i.e. to direct air flow to zones adjacent to remote portions of the cutter head, by using a water powered device mounted above the body of the machine remote from the cutter head, the devices including an outlet nozzle for relatively high pressure water positioned within a hollow cylindrical housing member and directed towards the remote portions of the cutter head. As the rapidly moving jet of water passed through the hollow housing member it induces an air flow through the device. Unfortunately the device is remote from the cutter head and cannot easily direct an air flow into the remote portions of the cutter head.

It is also known to mount a rotary cutter head on a hollow or axially bored driven shaft and to direct a jet of relatively high pressure water along the shaft towards the cutter head so that an air flow is induced along the bore of the hollow shaft to ventilate the remote portions of the cutter head. With such a ventilated cutter head it has been necessary to mount the outlet sprays for the relatively low pressure dust suppression fluid on the body of the machine remote from the cutter head where they tend to become damaged and from where they cannot always efficiently direct water flow into the cutting zone of the cutter head.

With both the above mentioned arrangements it is not always possible to obtain maximum benefit from both the ventilating apparatus and the dust suppression apparatus. In addition, the apparatus which is mounted on the body of the machine remote from the cutter head tends to become damaged in use and frequently has a relatively short operational life.

An object of the present invention is to provide apparatus for a cutter head which enables improved ventilation and dust suppression to be achieved.

According to the present invention apparatus for ventilating a mining machine cutter head of the kind adapted to be drivably mounted on a hollow or axially bored driven shaft and provided with at least one outlet spray for dust suppression fluid, comprises a component for attachment to the machine adjacent to the end of the driven shaft remote from the cutter head, the component having an inlet passage for dust suppression fluid, a hollow elongated member for extending the passage for dust suppression fluid along the axis of the driven shaft towards the cutter head, and outlet nozzle means for directing at least one air flow-inducing jet of fluid along the bore of the driven shaft, the outlet nozzle means being remote from the axis of the bore.

Preferably, the outlet nozzle means includes at least one outlet nozzle mounted on the component which is provided with second inlet passage for feeding fluid to the outlet nozzle.

Advantageously, the outlet nozzle is inclined to the axis of the bore.

Preferably, the elongated member feeds the dust suppression fluid to distributing means adapted to be mounted within the cutter head for interconnection with the outlet spray.

Conveniently, the component comprises releasable locking means for fixedly retaining at least a portion of the component to the remainder of the component, the said portion being fixed with respect to the elongated member and being rotatable with respect to the remainder of the component when the locking means is released.

The present invention also provides apparatus as defined above in combination with a mining machine cutter head.

The present invention also provides apparatus as defined above in combination with a mining machine.

Figure 2:
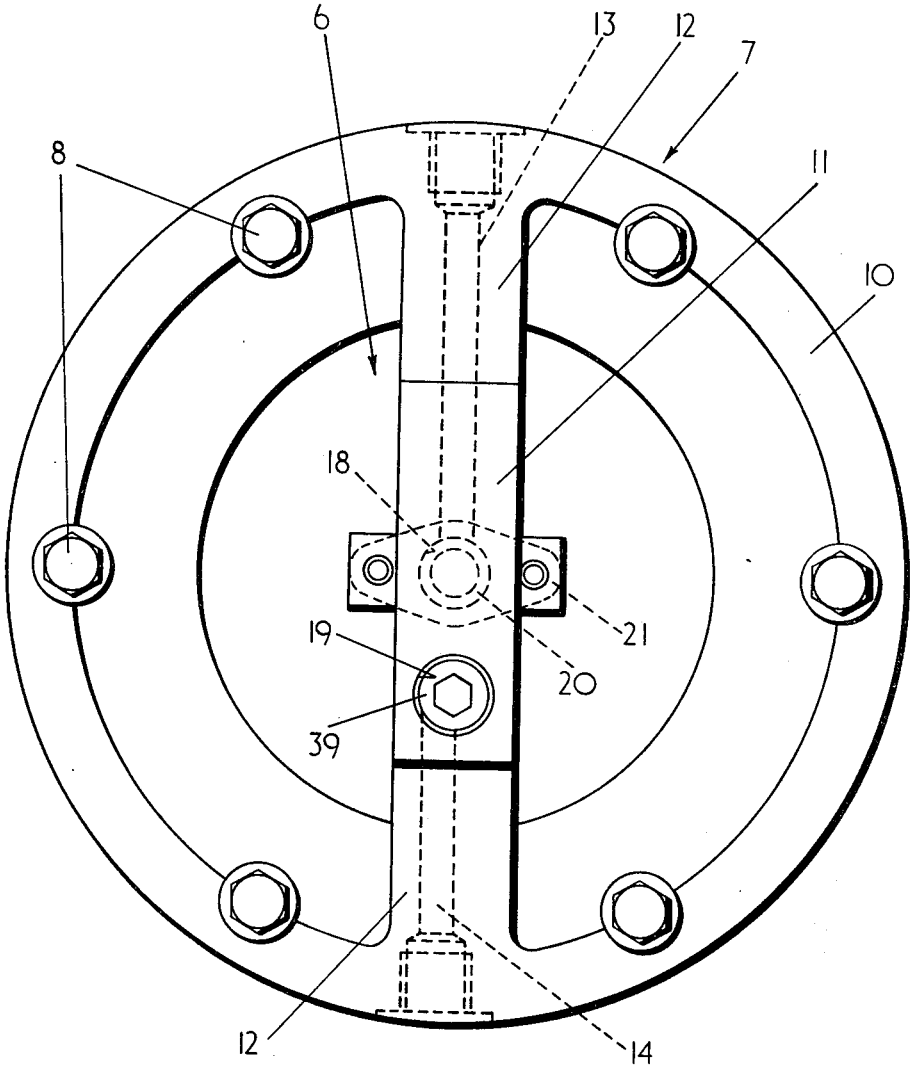

By way of example only, one embodiment of the present invention will be described with reference to the accompanying drawings, in which:

FIG. 1 is a sectional view through apparatus for ventilating a mineral mining machine cutter head, the apparatus being constructed in accordance with the present invention; and FIG. 2 is an incomplete end view of the apparatus of FIG. 1.

Referring to the drawings, the apparatus shown is for ventilating a rotary cutter head (a part of the outline of which is denoted by 1 in FIG. 1) of a well known shearer type mining machine (a part of the body of which is denoted by 2 in FIG. 1). In operation, the machine traverses to and fro along an armoured face conveyor (not shown) extending along a working face with its cutter head mounted on a hollow or axially bored driven shaft 3 for rotation about a horizontal axis 4. The driven shaft 3 is drivably connected to a motor (not shown) housed within the body 1 of the machine and has an axial bore 6 extending the full length of the shaft.

The apparatus comprises a component 7 bolted to the machine body 1 side by a ring of bolts 8 and constituted by a generally annular plate 10, a central portion 11 supported from the plate on two arms 12. Two inlet passages 13 and 14 are formed in the component 7, both the passages 13 and 14 extending from feed hose connections 16 and 17 along the arms 12 to outlets 18 and 19, respectively.

A hollow, elongated member constituted by a tube 20 is sealably and fixedly secured to the central portion 11 to extend the passage 13 along the axis 4 of the driven shaft bore 6. The tube 20 is retained in position by a lock ring 21 and a seal ring 23 seals the tube within the outlet 18. The tube 20 extends along the driven shaft bore 6 and feeds dust suppression fluid to distribution means 25 located within the cutter head 1 on the end of the driven shaft 3. The distribution means includes a block 26 formed with passages 27 (only one of which is shown in FIG. 1) for feeding relatively low pressure dust suppression fluid to passages 28 which are formed in the cutter head 1 and which feed sprays 100 (only one of which is shown) mounted on a radially outer portion of the cutter head 1 adjacent to the cutting zone. The block 26 also provides guide ducts 30

(only one of which is shown in FIG. 1) for an air flow induced along the driven shaft bore 3 as discussed later. An additional guide plate 31 is provided to guide the induced air flow towards the periphery of the cutter head 1.

The block 26 constitutes an abutment for the cutter head 1 which is thereby retained on the driven shaft 3, the block itself being retained in position by bolts 35. Various connecting seal arrangements and blanking plugs 36, 37 and 38 are provided to prevent loss of dust suppression fluid.

The passage 14 in the component 7 feeds relatively high pressure fluid to a nozzle 39 which is positioned in the central portion 11 remote from the axis 4 of driven shaft bore 6 and which is inclined to the axis 4. The nozzle is arranged to direct an air-flow inducing jet of fluid along the driven shaft bore 6. In order to assist entry of air into the bore 6 the inlet 40 is tapered.

The induced air-flow together with fluid from the nozzle 39 passes along the bore 6, through the guide ducts 30 and an annular aperture 41 towards the rear outer periphery of the cutter head.

Thus, in operation when the cutter head 1 is rotated by the driven shaft 3 relatively low pressure water is fed along the passage 13, through the tube 20 and distribution means 25 to the sprays on the cutter head which direct the water towards the cutting zone to suppress dust generated during cutting. Simultaneously, relatively high pressure water is fed along the passage 14 to the nozzle 39 to induce an air flow along the driven shaft bore 6 and through the guide duct 30 and annular aperture 41 to ventilate the rear of the cutter head adjacent to the coal face and thereby prevent the build up of methane gas concentrations. In addition, the water from the nozzle 39 discharging through the annular aperture 41 helps suppress dust generated during cutting in a zone which usually is not effected by water from the dust suppression sprays.

Thus, it can be seen from the above description that the present invention provides means for enabling a ventilated cutter head to be provided also with dust suppression sprays mounted on the cutter head.

The apparatus enables such a cutter head to be achieved simply and inexpensively.

In modifications of the invention the distribution means feeds dust suppression fluid to only those sprays currently in the cutting zone as the cutter head rotates. With such modifications the central portion 11 is rotatable with respect to the remainder of the component and releasable locking means are provided to retain the central portion against rotation. In order to change the zone of the cutter head in which the sprays are fed with dust suppression fluid the locking means are released and the central portion rotated until the desired zone is fed with fluid.

In modifications of the apparatus the outlet nozzle may be arranged with its axis parallel to the axis of the shaft.

In further modifications of the apparatus a plurality of outlet nozzles may be provided.

I claim:

1. Apparatus for ventilating a mining machine cutter head of the kind adapted to be drivably mounted on a hollow or axially bored driven shaft and provided with at least one outlet spray for dust suppression fluid, comprising a component for attachment to the machine adjacent to the end of the driven shaft remote from the cutter head, the component defining inlet means for dust suppression fluid, a straight hollow elongated member for extending said inlet means for dust suppression fluid along the axis of the driven shaft to a plurality of sprays in the cutter head, and outlet nozzle means radially spaced from the axis of the bore for directing at least one air flow-inducing jet of fluid along the bore of the driven shaft.

2. Apparatus as claimed in claim 1, in which the outlet nozzle means is mounted on the component, the component also defining second inlet means for feeding fluid to the outlet nozzle.

3. Apparatus as claimed in claim 2, in which the outlet nozzle is inclined to the axis of the bore.

4. Apparatus as claimed in claim 1, including distributing means adapted to be mounted within the cutter head for interconnection with the outlet spray.

5. Apparatus as claimed in claim 4, in which the component comprises releasable locking means for fixedly retaining at least a portion of the component to the remainder of the component, the said portion being fixed with respect to the elongated member and being rotatable with respect to the remainder of the component when the locking means is released.

6. A mining machine cutter head adapted to be drivably mounted on a hollow or axially bored driven shaft of a mining machine, including at least one outlet spray for dust suppression fluid, and apparatus for ventilating the cutter head, the apparatus comprising a component for attachment to the machine adjacent to the end of the driven shaft remote from the cutter head, the component defining inlet means for dust suppression fluid, a straight hollow elongated member for extending said inlet means for dust suppression fluid along the axis of the driven shaft to a plurality of sprays in the cutter head, and outlet nozzle means radially spaced from the axis of the bore for directing at least one air flow-inducing jet of fluid along the bore of the driven shaft.

7. A mining machine including a hollow or axially bored driven shaft, a cutter head drivably mounted on the hollow or axially bored driven shaft, and apparatus for ventilating the cutter head, the apparatus comprising a component for attachment to the machine adjacent to the end of the driven shaft remote from the cutter head, the component defining inlet means for dust suppression fluid, a straight hollow elongated member for extending said inlet means for dust suppression fluid along the axis of the driven shaft to a plurality of sprays in the cutter head, and outlet nozzle means radially spaced from the axis of the bore for directing at least one air flow-inducing jet of fluid along the bore of the driven shaft.

8. In an apparatus for ventilating a mineral mining machine cutter head of the kind adapted to be drivably mounted on an axially bored driven shaft and provided with at least one outlet nozzle for dust suppression fluid, and having a fixed component for fixed attachment to the machine adjacent to the end of the driven shaft remote from the cutter head, the fixed component having fluid inlet means and fluid outlet means, the improvement comprising a straight hollow elongated member extending along the axis of the driven shaft to connect the fixed component to the said at least one outlet nozzle in the cutter head and at least one second nozzle means on said fixed component and radially spaced from the axis of the bore for directing at least one air flow-inducing jet fluid along the bore of the driven shaft.

* * * * *